US007219888B2

(12) United States Patent
Trovinger et al.

(10) Patent No.: US 7,219,888 B2
(45) Date of Patent: May 22, 2007

(54) MULTI-PASS DESKEW METHOD AND APPARATUS

(75) Inventors: Steven W. Trovinger, Los Altos, CA (US); Akinobu Kuramoto, Pleasanton, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 401 days.

(21) Appl. No.: 10/887,631

(22) Filed: Jul. 9, 2004

(65) Prior Publication Data

US 2004/0239027 A1 Dec. 2, 2004

Related U.S. Application Data

(63) Continuation of application No. 10/298,500, filed on Nov. 18, 2002, now Pat. No. 6,834,853.

(51) Int. Cl.
*B65H 7/02* (2006.01)

(52) U.S. Cl. ..... 271/227; 271/242; 271/244

(58) Field of Classification Search ..... 271/242, 271/227, 902, 245, 244, 246, 243
See application file for complete search history.

(56) References Cited

U.S. PATENT DOCUMENTS 3,884,103 A * 5/1975 Namba ..... 83/156
4,353,274 A * 10/1982 Shimizu ..... 83/156
5,059,775 A * 10/1991 Nakayama ..... 235/456
5,246,224 A * 9/1993 Matsuno et al. ..... 271/242
5,280,899 A * 1/1994 Kida et al. ..... 271/10.1
5,466,079 A * 11/1995 Quintana ..... 400/579
5,509,645 A * 4/1996 Shinno et al. ..... 270/58.17
5,596,399 A * 1/1997 Dempsey et al. ..... 399/45
5,678,159 A * 10/1997 Williams et al. ..... 399/395
5,794,176 A * 8/1998 Milillo ..... 702/150
6,099,225 A * 8/2000 Allen et al. ..... 412/32
6,374,025 B1 * 4/2002 Iriyama et al. ..... 385/117

FOREIGN PATENT DOCUMENTS

JP 57175643 A * 10/1982
JP 62259944 A * 11/1987

* cited by examiner

*Primary Examiner*—Patrick Mackey
*Assistant Examiner*—Kaitlin Joerger

(57) ABSTRACT

A method for aligning print media on a feedpath includes the steps of: aligning a sheet of print media using a deskew mechanism; measuring the skew of the sheet after it has been aligned; and comparing the measured skew with a specified skew, and if the measured value is greater than the specified value, reversing the sheet through the deskew mechanism followed by repeating the aligning, measuring and comparing steps. An apparatus for implementing alignment of print media on a feedpath comprises a deskew mechanism and sensors positioned downstream on the feedpath from the deskew mechanism to provide data sufficient to calculate the skew of the sheet.

6 Claims, 8 Drawing Sheets

MULTI-PASS DESKEW METHOD AND APPARATUS

CROSS REFERENCE TO RELATED APPLICATION

This is a continuation of application Ser. No. 10/298,500 filed on Nov. 18, 2002 now U.S. Pat. No. 6,834,853, which is hereby incorporated by reference herein.

TECHNICAL FIELD

The invention relates generally to the field of media transport and more particularly to print media deskew methods and structural arrangements for use in print applications.

BACKGROUND ART

In many print media handling applications, it is desirable to minimize skew, where "skew" is defined as the misalignment of print media as a leading edge approaches or reaches a position in which print media orientation affects operations. For applications in which the print media is a sheet of paper or a transparency, the skew will often vary from sheet to sheet. sheet-wise booklet making is one example of an application in which minimizing skew is an important consideration. U.S. Pat. No. 6,099,225 to Allen et al., which is assigned to the assignee of the present invention, describes what is referred to as a sheet-wise method of booklet making, since the finishing operations are performed on a sheet-by-sheet basis. The finishing operations include aligning, trimming, scoring, folding, and stacking and stapling, as illustrated in FIG. 1. Each sheet is trimmed to a length that is determined by its sequence in the booklet and by the thickness of the sheets that form the booklet. A sheet that is folded to provide the outer pages of a booklet may not be trimmed at all, while the sheet that is folded to provide the center pages of the booklet will be trimmed by the greatest amount. Because sheets are individually trimmed prior to final assembly, random misalignment of sheets would result in a ragged, unfinished appearance to the booklet. The random skew that is considered to be allowable will vary with the expectations of the manufacturer, but is often a maximum total skew that is in the range of one sheet thickness (e.g., ~100 microns) to two sheet thicknesses (e.g., ~200 microns). For comparison, the typical acceptable skew for a printer is +/−1500 microns.

The skew of print media can be reduced by using buckle deskew methods or methods utilizing differentially driven nips. Some deskew mechanisms utilize multiple print media sensors in implementing print media deskew.

U.S. Pat. No. 6,374,075 to Benedict et al. teaches a method for correcting the skew of print media on a feedpath utilizing one or more pairs of differentially driven nips. The operating speeds of the individual nips are determined from data provided by print media sensors positioned along the edge of the feedpath. These sensors include point sensors and CCD arrays. The differentially driven nips re-orient the print media as it is fed along the feedpath.

U.S. Pat. No. 5,794,176 to Milillo also teaches a method for deskewing print media on a feedpath utilizing a pair of differentially driven nips. The operating speeds of the individual nips are determined from data provided by two print media sensors positioned immediately downstream on the feedpath from the nips and on an axis which is perpendicular to the feed direction of the feedpath. These sensors are positioned to detect the leading edge of the print media, with the time delay between detections of the edge by the two sensors being used to generate control signals for motors driving the individual nips.

U.S. Pat. No. 5,678,159 to Williams et al teaches a method for correcting the skew of print media on a feedpath which utilizes data from print media leading edge sensors positioned along the center of the feedpath and print media edge sensors positioned along the edge of the feedpath. This data is used to determine the operating speed of a pair of differentially driven nips which re-orient the print media as it is fed along the feedpath.

U.S. Pat. No. 5,466,079 to Quintana teaches a buckle deskew method which utilizes an optical interrupt sensor for print media leading edge detection. Print media is delivered from feed rollers and is passed through deskew rollers until the leading edge is detected. The print media is then reversed out of the deskew rollers, while being held by the feed rollers, until the leading edge is free to align in the nip of the deskew rollers. The alignment is assisted by a buckle which forms in the print media. Finally, the deskewed print media is again fed through the deskew rollers and along the feedpath. The sensor is mounted so that it can be shuttled across the feedpath to also detect a side edge of the print media. Detection of the leading and side edges allows the orientation of the print media to be determined.

Japanese Patent Abstract No. 57175643 teaches a buckle deskew method in which a buckle is formed in print media as it is fed into stalled deskew rollers, thus aligning the leading edge of the print media square to the nip of the deskew rollers. The deskew rollers are then activated, feeding the now deskewed print media along a feedpath.

These methods and apparatus are used in printing and copying applications in which the acceptable skew is much greater than for sheet-wise booklet making. What is needed is a deskew method and apparatus, that is suitable for use in applications in which precise alignment is a significant concern, such as sheet-wise booklet making. Furthermore, a deskew method and apparatus is needed which can be used with desktop printing and booklet making systems in which cost is a significant concern.

SUMMARY OF THE INVENTION

The present invention provides a method for aligning print media on a feedpath. A sheet of print media is processed through an alignment mechanism and the alignment is then measured. If the measured alignment is not satisfactory, the sheet is reversed through the alignment mechanism, allowing the process to be repeated. These steps are repeated until the measured alignment is satisfactory. More specifically, the method includes the steps of: (1) aligning a sheet of print media using a deskew mechanism; (2) measuring the skew of the sheet after it has been aligned; and (3) comparing the measured skew with a specified skew. If the measured value is greater than the specified value, the sheet is reversed through the deskew mechanism to allow a repetition of the aligning, measuring and comparing steps.

The invention provides an apparatus for implementing alignment of print media on a feedpath. The apparatus comprises a deskew mechanism and sensors positioned downstream on the feedpath from the deskew mechanism. The sensors are configured to detect a leading edge of a sheet of print media on the feedpath and are cooperative with a controller to return a sheet to the deskew mechanism upon determining that the sheet has not been adequately deskewed.

DETAILED DESCRIPTION

Figure 2:
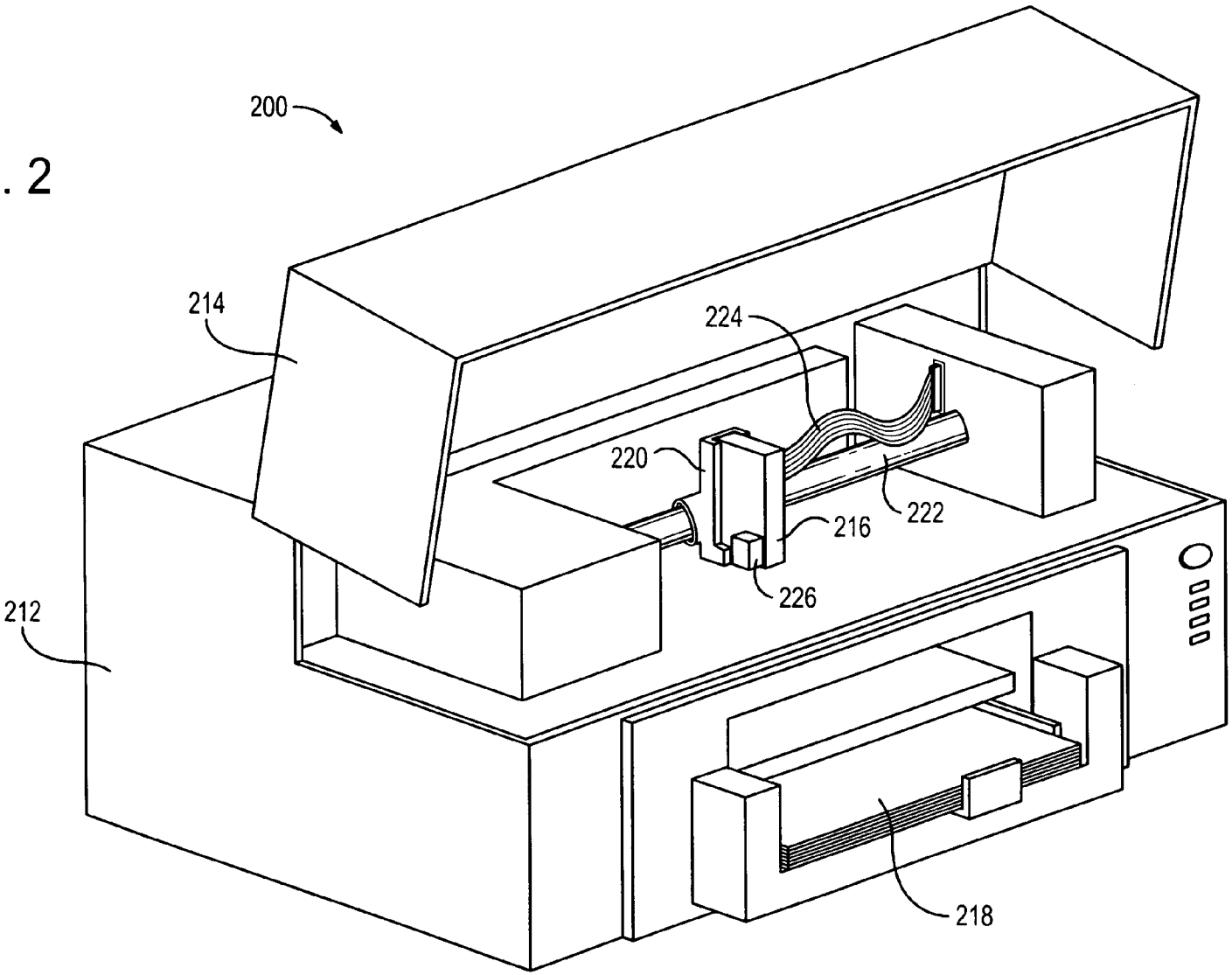
FIG. 2 is a perspective view of a printer, which is one example of a device that may use the deskew apparatus in accordance with the invention.

With reference to FIG. 2, a printer 200 is illustrated as merely one example of a device which may be adapted to include a deskew apparatus in accordance with the invention. Other devices may be similarly adapted. As used herein, "print media" refers to all types of paper, photographic paper, transparencies and other media used in devices such as printers and desktop publishing systems.

The printer 200 includes a body 212 and a hinged cover 214. Inkjet technology is employed, but other technologies may be used. An ink-jet printhead 216 is attached to a carriage 220 that moves back and forth along a carriage transport rail 222. A flexible cable 224 connects the components of the print carriage to a print engine, not shown. The flexible cable includes electrical power lines, clocking lines, control lines, and data lines. Nozzles of the inkjet printhead are individually triggered to project droplets of ink onto print media delivered from a media supply 218. During each print operation, the print media is stepped in one direction, while the inkjet printhead 216 is moved along the transport rail 222 in the perpendicular direction.

Figure 3:
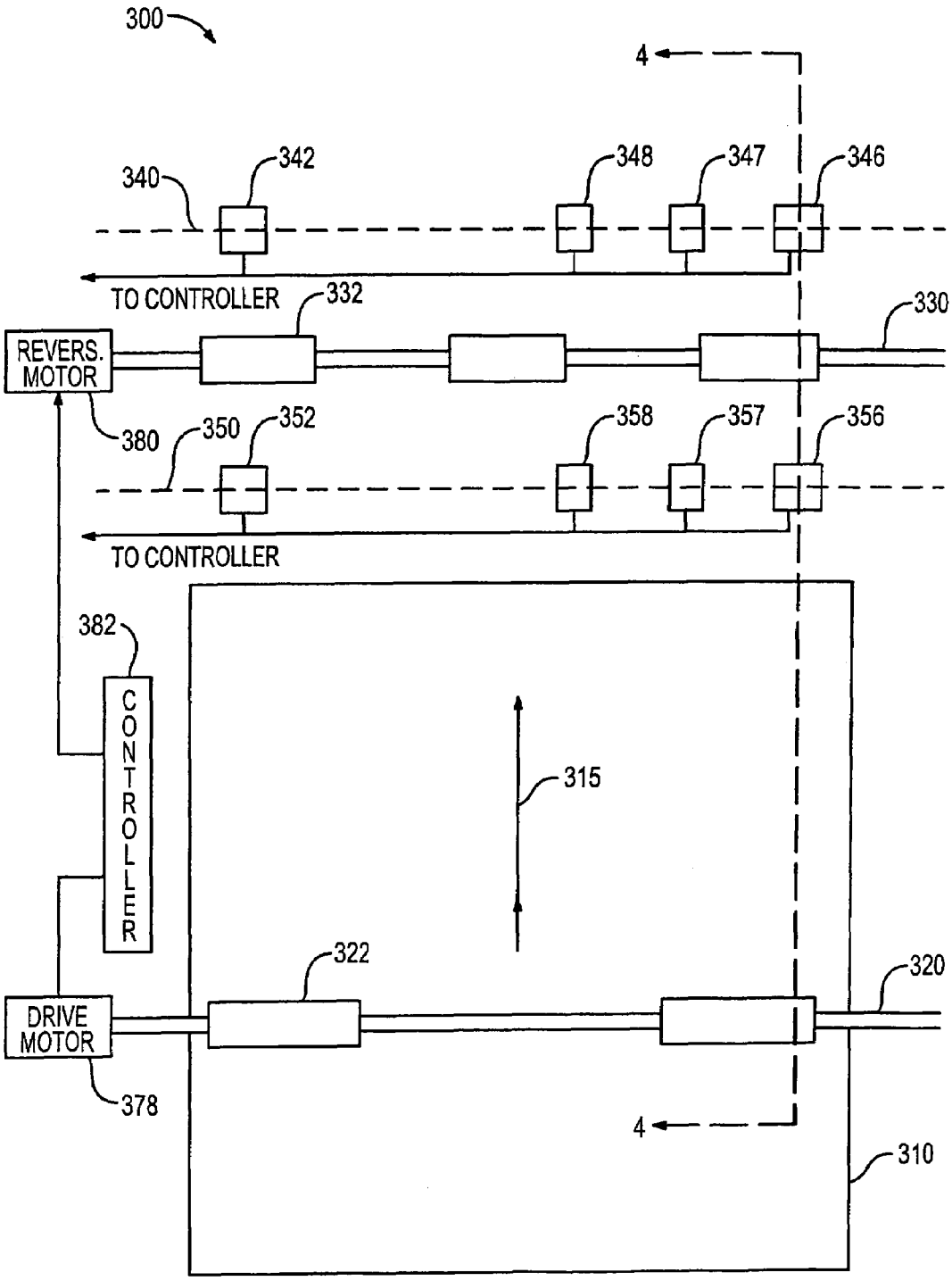
FIG. 3 is a top plan view of one embodiment of a deskew apparatus in accordance with the invention.
Figure 4:
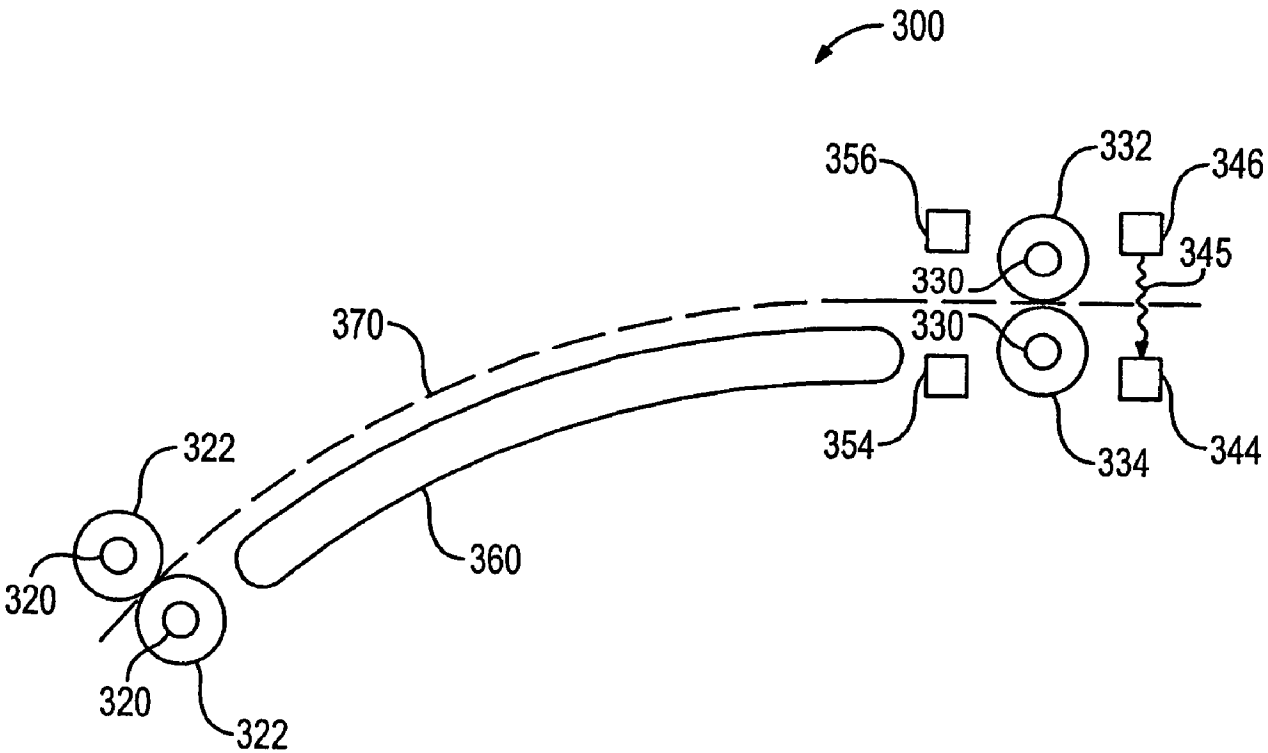
FIG. 4 is a cross-section through the deskew apparatus of FIG. 3, in the vertical plane containing 4—4.

FIGS. 3 and 4 show an embodiment of a deskew apparatus 300 located along a print media feedpath 370 for use in the printer 200, as one example. The deskew apparatus includes feed roller axes 320, feed rollers 322, deskew roller axes 330, deskew rollers 332 and 334, a sensor alignment axis 340, sensor components 342, 344, 346, 347 and 348, a second sensor alignment axis 350, second sensor components 352, 354, 356, 357 and 358 and a guide structure 360. As will be described more fully below, sensor components 342, 346, 347 and 348 may be light emitters, while sensor component 344 may be a light detector in an array of detectors that corresponds with the array of light detectors. Thus, four sensors are available. Alternatively, the emitter/detector pairing may be reversed. This applies to the second sensor components as well. A sheet of print media 310 is shown being fed, by feed rollers 322, in direction 315 through the deskew apparatus along feedpath 370. A drive motor 378 is controlled to operate the feed rollers. While other embodiments are contemplated, the feedpath is substantially horizontal. The length of the feedpath between the feed rollers and the deskew rollers is less than the length of the sheet. While two feed rollers 322 are shown on each feed roller axis 320, the number may be more or less. Similarly, there may be more or less than three deskew rollers 332 and 334 on each deskew roller axis 330. Hereafter, a deskew apparatus is defined to comprise a deskew mechanism for aligning print media and sensors for measuring the alignment of the print media.

As shown in FIG. 4, the deskew rollers 332 and 334 are configured to form a nip in which print media are received from an upstream side of the feedpath. The deskew rollers are pinch rollers 334 and drive rollers 332 that are rotated by a reversible motor 380 of FIG. 3. In one embodiment, the drive rollers 332 are made of a hard material in order to reduce slipping of the print media while the print media are moving through, or being held by, the deskew rollers. Typically, drive rollers are formed of a compliant material. In another embodiment, the drive rollers are grit rollers in order to minimize slippage. Grit rollers are known in the art for their use in pen plotters.

The guide structure 360 guides print media into the nip of the deskew rollers. The guide structure is rigid, and in one embodiment is a wire frame. In certain embodiments, the guide structure is arcuate. This generally curved shape assists in the formation of a buckle in a sheet of print media, as discussed below. In other embodiments, the guide structure has upper and lower members (not shown), positioned above and below the feedpath.

In FIG. 3, the sensor components 342, 346, 347 and 348 are shown positioned along axis 340 as components of four sensors. Axis 340 is substantially perpendicular to direction 315 which is the direction of movement of print media along the feedpath and is also substantially parallel to the deskew roller axes 330. A small misalignment of the axis 340 relative to the direction 315 and axes 330 can be compensated by an offset value for each sensor. The sensors provide data to a controller 382 to detect the leading edge of a sheet of print media as it emerges from the deskew rollers. The leading edge is detected by at least two sensors in order to provide data to calculate the skew of the sheet using the processing capability of the controller. Calculation of the skew is more accurate if data is available from two sensors which are spaced apart by approximately the width of the sheet. In some embodiments only two sensors are used. In order to accommodate print media of different widths, while having sensors spaced by a distance approaching that of the different widths of sheets, a plurality of sensors are used in spaced relationship along the axis 340. It is well known in the printer art for print media to be aligned to one side of the feedpath, irrespective of the print media size. The embodiment shown in FIG. 3 has sensors configured for print media aligned to the left hand side of the feedpath, such that sensor component 342 is positioned near the left hand edge for all different print media. Sensor components 346, 347 and 348 are spaced apart such that one of them will be close to the right hand edge for a selection of widths of print media. For example, the embodiment of FIG. 3 could have the sensor components 346, 347 and 348 spaced so as to accommodate US letter (8.5 inch×11 inch), A4 (210 mm×297 mm), and US executive (7.25 inch×10.5 inch) size print media. Other embodiments may utilize a larger number of sensors or a different configuration. For example, an alternative embodiment in which print media is aligned to the left hand side of the feedpath has one fixed sensor, on the left hand side, and one movable sensor that is moved to be close to the right hand side edge of the print media, thus accommodating different print media widths. The movable sensor can be a sensor mounted on a carriage which moves along a carriage transport rail aligned to the sensor axis. Such carriages are well known in the art and are used in printers, such as the printer of FIG. 2. In FIG. 2, a sensor 226 is shown as being mounted for movement as the carriage 220 moves along the carriage transport rail 222.

In FIG. 3, the second sensor components 352, 356, 357 and 358 are shown positioned along axis 350 to define positions of second sensors. Axis 350 is substantially perpendicular to direction 315 and substantially parallel to the deskew roller axes 330. The second sensors provide data to the controller 382 to detect the trailing edge of a sheet of print media before it enters the deskew rollers. The same considerations apply to the trailing edge sensors as to the leading edge sensors regarding measurement of skew and accommodation of print media of different widths. Measurement of sheet alignment by both leading edge and trailing edge sensors provides data to the controller in order to determine the parallelism of these two edges. One or more of the second sensors can be used to detect a trailing edge of a sheet of print media. When combined with leading edge detection by the leading edge sensors, this provides the data to calculate the length of the sheet. Both the length of the sheet and the parallelism of the leading and trailing edges are useful measurements for applications such as sheet-wise booklet making.

The sensors and second sensors are typically optical sensors which are configured to detect edges of print media. In some embodiments the sensors are optical interrupt sensors, having a light emitting member and a light detecting member positioned facing each other on opposite sides of the feedpath. For example, referring to FIG. 4, a light emitting member 346, a beam of light 345, and a light detecting member 344 are shown. When a sheet of print media passes between the emitter and detector, the sheet interrupts the light beam and hence its edge is detected. In other embodiments, not shown, the emitter and detector may both be positioned above the feedpath, such that a sheet of print media is detected when light from the emitter is either reflected or scattered back to the detector. Examples of light emitting members are a light emitting diode (LED) and a laser. An example of a detecting member is a photodiode.

Figure 5:
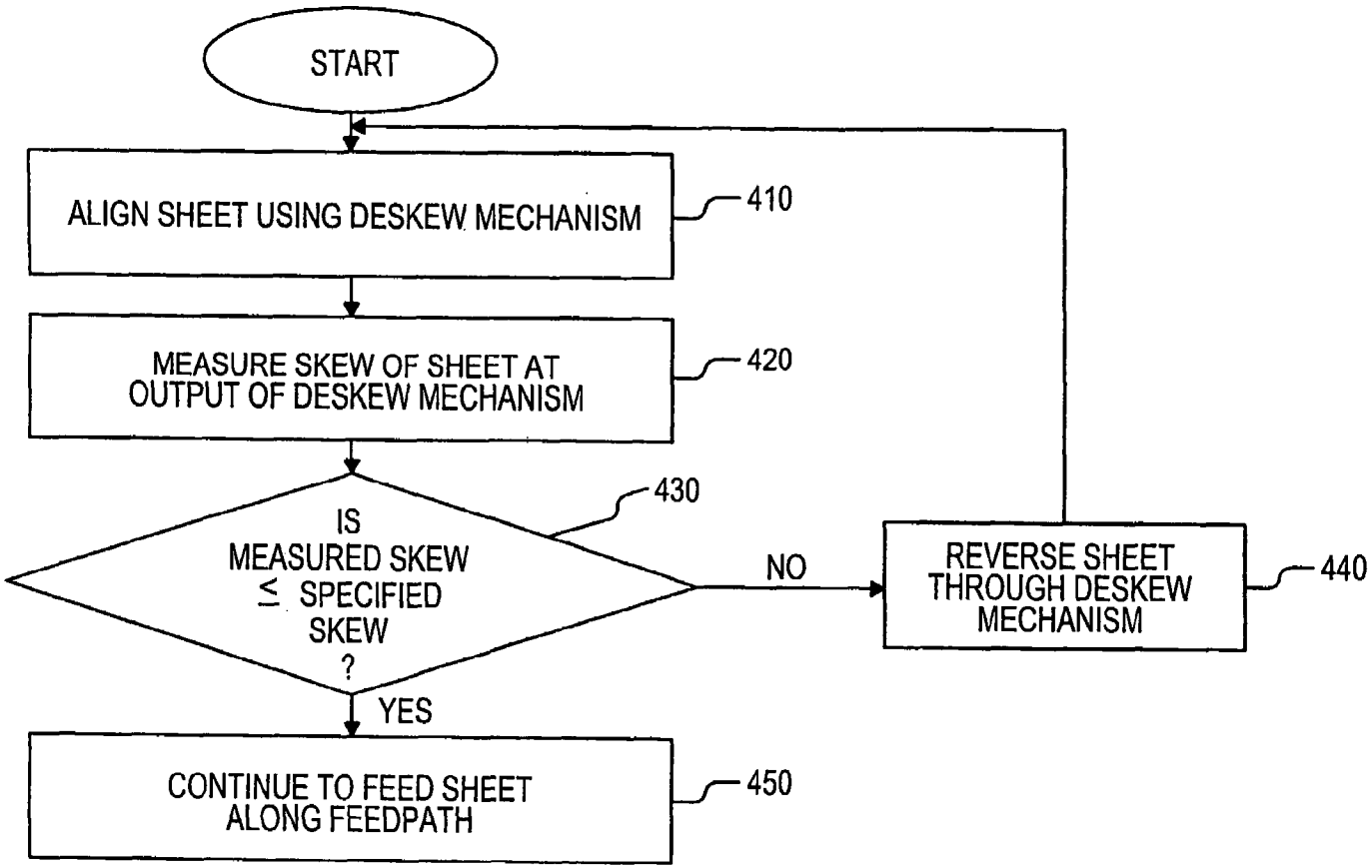
FIG. 5 is a flow chart for one embodiment of a sheet alignment method in accordance with the invention.

FIG. 5 is a flow chart for a general embodiment of a method for aligning print media along a feedpath in accordance with the invention. The first step, aligning step 410, uses a deskew mechanism to align a sheet of print media to the feedpath. In FIG. 3, the drive motor 378 and the reversible motor 380 rotate rollers 322 and 332, respectively, to progress the sheet 310 along the feedpath. In the second step, measuring step 420, the skew of the sheet is measured at the output of the deskew mechanism. Skew may be measured using the sensors and the controller 382. In the third step, represented by 430 and 440, the measured skew value calculated by the controller for the sheet is compared with a specified skew, and if the measured skew is greater than the specified skew, then the sheet is reversed (by operation of the motor 380) through the deskew mechanism, and steps 410, 420 and 430 are repeated. When the measured skew is found to be less than or equal to the specified skew, the sheet continues along the feedpath, as represented by 450.

Some embodiments of the method limit the number of times that the sheet is reversed through the deskew mechanism in order to attempt to attain a desired alignment of the sheet. For example, after ten passes through the deskew mechanism the sheet is allowed to continue along the feedpath even though a desired alignment has not been attained. Alternatively, the sheet is rejected on failing to attain the desired alignment after ten passes. The maximum number of passes can be set depending on throughput requirements. The controller 382 of FIG. 3 can be programmed to incorporate this limit in the method.

Figure 6:
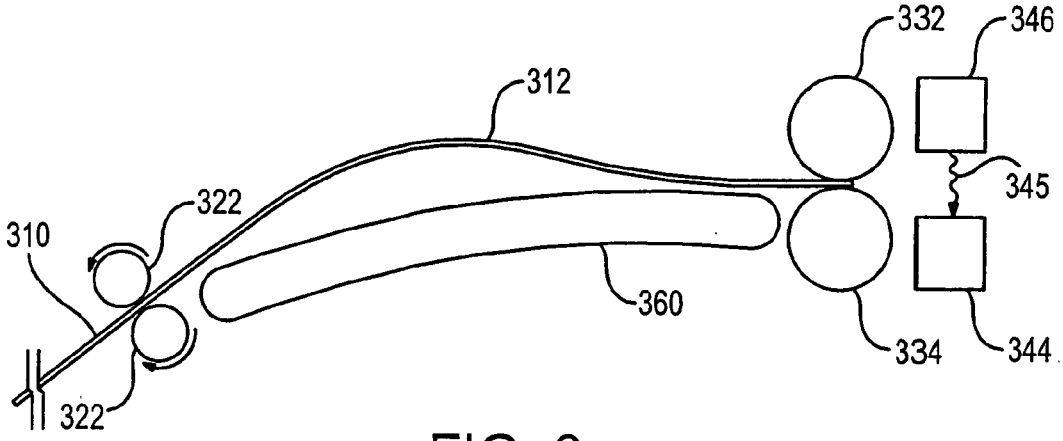
FIG. 6 is a side view of the deskew apparatus in a condition in which print media is being fed along a feedpath into a nip of stalled deskew rollers.

A specific embodiment of the alignment method will be described with reference to FIGS. 6, 7 and 8. FIG. 6 shows a sheet of print media 310 being driven by feed rollers 322 into the nip formed by deskew rollers 332 and 334. The deskew rollers are stalled. Consequently, a buckle 312 forms as the sheet continues to be driven into the nip. The buckle assists in driving the sheet into the nip, encouraging the leading edge of the sheet to align squarely in the nip. Sensor components 344 and 346 form an optical interrupt sensor, where sensor component 346 emits a beam of light 345 which is detected by sensor component 344. Next, the deskew rollers are activated in the forward direction, feeding the leading edge of the sheet through the deskew rollers. Activation of the deskew rollers can be based on detection of the buckle 312 (sensors not shown), or the leading edge of the sheet can be detected by the second sensors (see FIG. 4) as the sheet approaches the deskew rollers, triggering activation of the deskew rollers after a suitable time delay.

Figure 7:
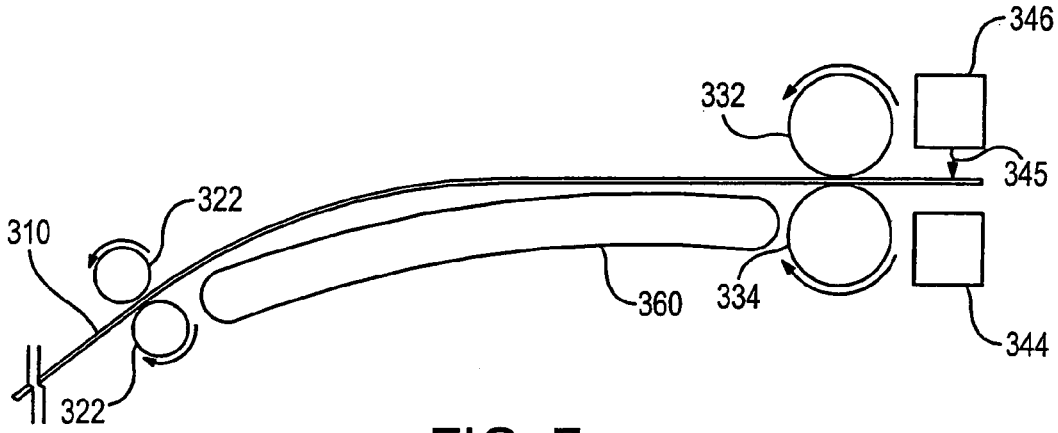
FIG. 7 is a side view of the deskew apparatus in a condition in which the skew of the print media is being measured.

FIG. 7 shows the sheet 310 being fed by both the feed rollers 322 and the deskew rollers 332 and 334. The leading edge of the sheet is shown as having just interrupted the light beam 345, and consequently will have been detected. Detection of the sheet at several points (at least two) along its leading edge allows the skew of the sheet to be calculated. Should the skew of the sheet be unsatisfactory, as determined by comparing the measured skew with a specified skew, then the sheet is reversed through the deskew rollers, as shown in FIG. 8. The sheet is shown as being fed in the forward direction by the feed rollers 322, even when the leading section of the sheet is being reversed. The combination of the reversing of the sheet through the deskew rollers and the feeding forward through the feed rollers gives rise to a buckle 312 in the sheet. The sheet is reversed until the leading edge is free of the rollers and is sitting in the nip, which is the approximate configuration shown in FIG. 6 (the only difference being that more of the sheet is now situated between the feed rollers and the deskew rollers, giving rise to a larger buckle). The alignment method is then repeated.

Figure 8:
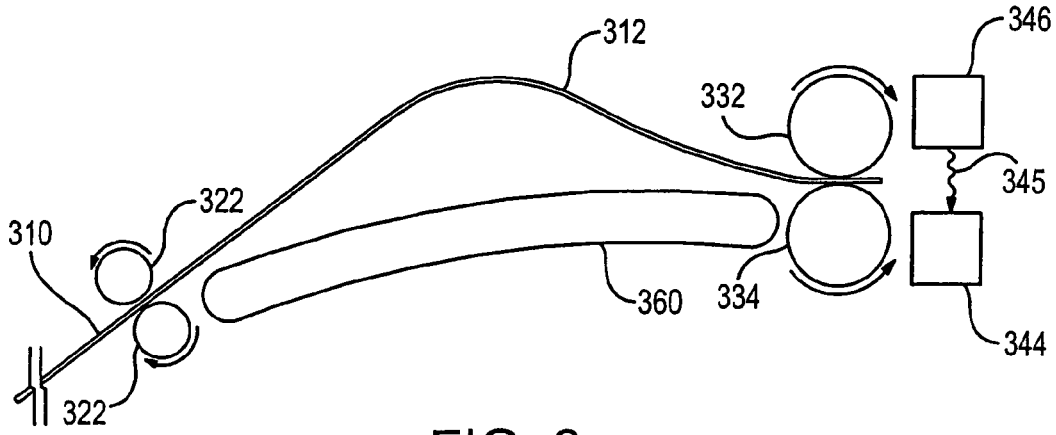
FIG. 8 is a side view of the deskew apparatus in a condition in which the print media is being reversed through the deskew rollers.

In FIGS. 6, 7 and 8, the feed rollers are shown to be feeding the sheet forward at all steps. In some embodiments, the feed rollers are operated continuously at the same rate. This mode of operation will limit the number of times the alignment steps can be repeated, since once the sheet is completely fed through the feed rollers, it can no longer be aligned using the method of the invention. Clearly, the faster the operation of the deskew rollers and the sensors, the larger the number of repeats of the alignment steps that can be accommodated. In other embodiments, the feed rollers are stalled after the first alignment step, and are only reactivated in the forward direction when an acceptable skew is measured. This allows for as many repeats of the alignment steps as an application can tolerate.

As discussed previously, the sheet shown in FIG. 8 is reversed through the deskew rollers 332 and 334 until the leading edge is free of the rollers and is sitting in the nip. In embodiments in which the drive roller 332 is a grit roller, there is the possibility that the leading edge of the sheet may be caught on a grit particle and therefore not be free to align in the nip. To overcome this problem, the deskew rollers can be vibrated or "buzzed" after the sheet has been reversed through the deskew rollers. Another solution to this problem is to continue to operate the deskew rollers in reverse for some time beyond the time at which the leading edge of the sheet reaches the nip of the rollers. Furthermore, the rollers can be rotated in reverse until the leading edge of the sheet, when sitting in the nip, is in contact with a different part of the rollers for each time the alignment is repeated. This procedure is effective in mitigating the effect a large grit particle can have on the alignment process (an undesirable skew can result from a large grit particle being positioned in the nip of the drive roller during the alignment of a sheet).

Using either an encoder in conjunction with the reversible motor 380 or a reversible motor which is a stepper motor will facilitate the methods described above. These configurations of the reversible motor allow the length of sheet that has been fed through the deskew rollers, in either direction, to be monitored.

In the testing of an alignment method in accordance with the invention, an alignment apparatus as in FIG. 3 was used. The apparatus was connected to a paper tray at its input. Two leading edge optical interrupt sensors were used, positioned downstream from the deskew rollers and approximately 1 cm from each side edge of the sheet. The deskew drive roller axis was driven by a servo motor with an encoder, calibrated to give the length of the sheet fed through the deskew rollers. When the leading edge sensors detected the sheet, the encoder reading was captured. Subtraction of the encoder readings from the two sensors (including an offset due to a small misalignment of the axis of the sensors relative to the axes of the deskew rollers) gave a length measurement that was representative of the skew of the sheet. Table 1 has the skew data collected for ten sheets. The specified acceptable skew value was +/−50 microns and the number of times the alignment steps had to be repeated is given by the "Try Number." This data shows that the alignment method of the invention is capable of aligning a succession of sheets of print media to within a tolerance of less than +/−100 microns, which is often used as the standard in sheet-wise booklet making. For comparison, the typical acceptable skew for a printer is +/−1500 microns.

TABLE 1

Performance Data for An Embodiment of the Alignment Method of the Invention

| Sheet Number | Try Number | Skew Value/microns |
|---|---|---|
| 1 | 1 | −100 |
| | 2 | −430 |
| | 3 | −1015 |
| | 4 | 25 |
| 2 | 1 | −25 |
| 3 | 1 | −125 |
| | 2 | −355 |
| | 3 | −230 |
| | 4 | −75 |
| | 5 | −150 |
| | 6 | −25 |
| 4 | 1 | −50 |
| 5 | 1 | 0 |
| 6 | 1 | 0 |
| 7 | 1 | −100 |
| | 2 | −405 |
| | 3 | −785 |
| | 4 | 965 |
| | 5 | 815 |

TABLE 1-continued

Performance Data for An Embodiment of the Alignment Method of the Invention

| Sheet Number | Try Number | Skew Value/microns |
|---|---|---|
| | 6 | 50 |
| 8 | 1 | −50 |
| 9 | 1 | −150 |
| | 2 | −405 |
| | 3 | −125 |
| | 4 | −125 |
| | 5 | 0 |
| 10 | 1 | 180 |
| | 2 | 75 |
| | 3 | −455 |
| | 4 | −50 |

Figure 9:
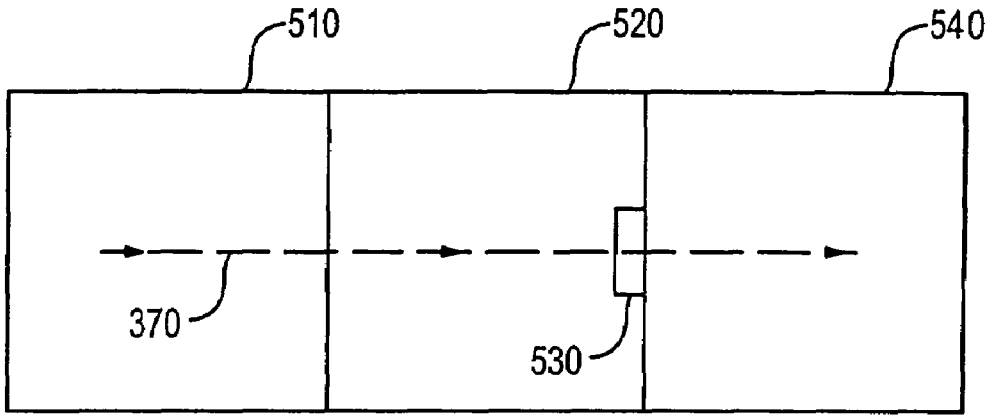
FIG. 9 is a block diagram of the coupling of the deskew apparatus with other devices in which print media is manipulated.

FIG. 9 illustrates the integration of the deskew mechanism 520 and plurality of sensors 530 with other stand-alone print media devices which utilize a print media feedpath 370. The print media feedpath is shown as starting in a first print media device 510, passing through the deskew mechanism and plurality of sensors, where sheets of the print media are aligned, and finishing in a second print media device 540. Examples of the first and second print media devices include (1) a printer and a sheet-wise booklet finisher that individually trims sheets depending upon their position within a booklet, (2) a paper tray loaded with pre-printed print media and a sheet-wise booklet finisher, and (3) a paper tray and a full bleed printer. Examples (1) and (2) are different embodiments of sheet-wise booklet makers. In FIGS. 3 and 4, the deskew mechanism is shown as including the feed rollers 322. However, in some applications it may be preferred to instead use the mechanism that is the sheet exit mechanism for the first print media device 510. In such applications, the first device 510 supplies the sheets to the deskew mechanism 520 in such a way that the feed rollers 322 are no longer necessary within the deskew mechanism; in which case the first device 510 is comprised of a feed mechanism coupled to a supply of sheets of print media.

When an alignment apparatus is integrated with a printer and a sheet-wise booklet finisher, forming a sheet-wise booklet maker, communication between the component devices may be desirable. For example, if numerous attempts are required to successfully align a particular sheet, then a signal can be sent from the alignment apparatus to the printer to delay the printing of the next sheet. Furthermore, if it is determined that a particular sheet cannot be aligned to specification, then this sheet can be rejected and a signal can be sent to the printer to produce a replacement sheet.

Figure 10:
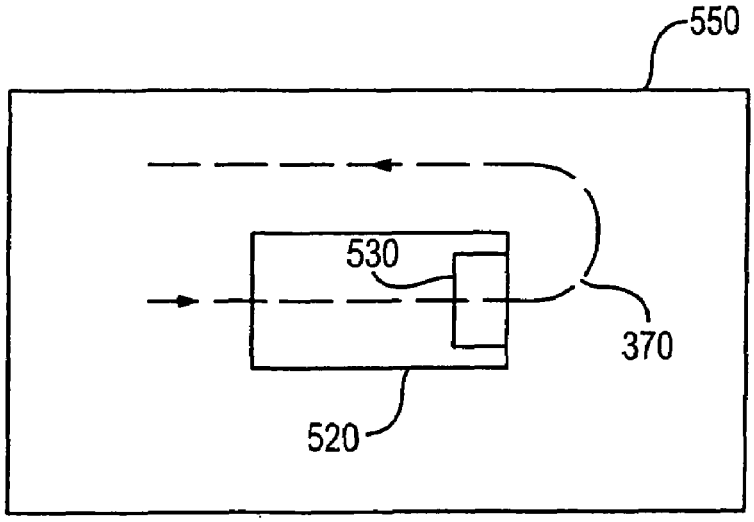
FIG. 10 is a block diagram of the integration of the deskew apparatus into a device in which print media is manipulated, such as in the printer of FIG. 2.

In FIG. 10, the deskew mechanism 520 and plurality of sensors 530 are shown as being incorporated into a print media device 550 having a feedpath 370. By incorporating the deskew mechanism into the print media device, the sheets of print media may be accurately aligned. Possible examples of the third media device include the printer 200 of FIG. 2, sheet-wise booklet finishers, and full bleed printers.

Figure 1:
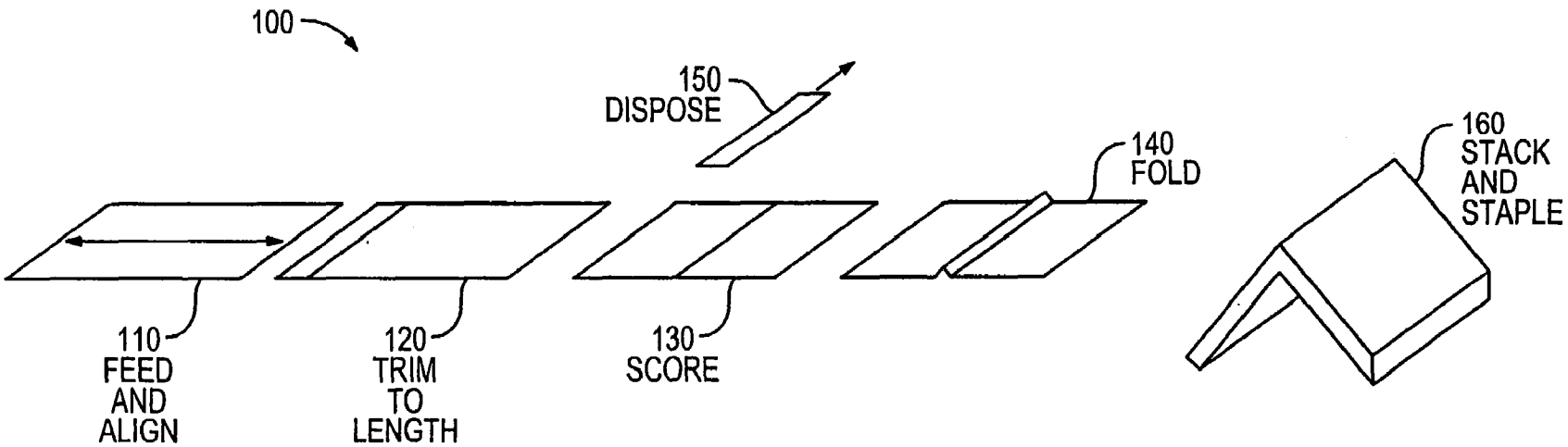
FIG. 1 (PRIOR ART)
FIG. 1 illustrates known process steps of sheet-wise booklet making.
Figure 11:
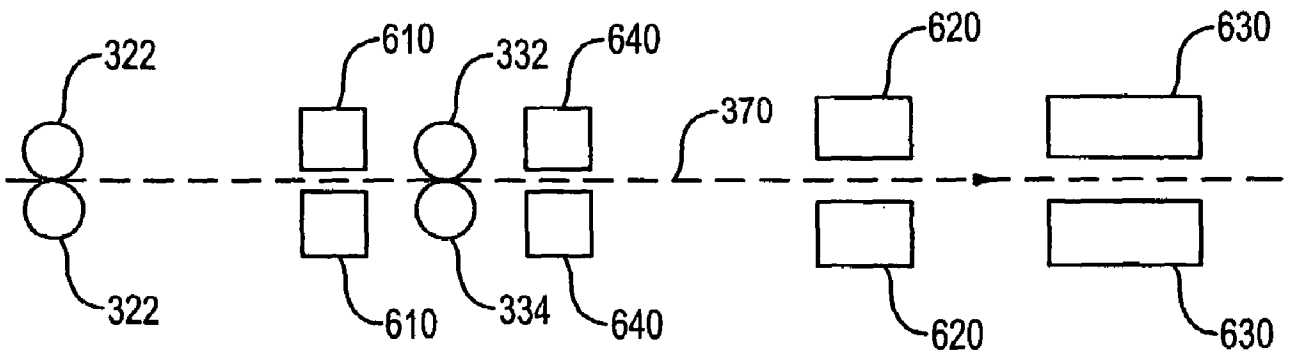
FIG. 11 is a diagrammatic illustration of the integration of the deskew apparatus into a sheet-wise booklet finisher.

Perhaps the application with the lowest skew tolerance is sheet-wise booklet making, since finishing operations are often performed on a sheet-by-sheet basis. For booklets that are formed by folding each sheet at its center and stapling the folded sheets together, sheets at the center of the booklet should be shorter than those that are away from the center. Thus, the sheet trimming is carried out as a function of the size of the booklet, the thickness of the individual sheets, and the positions of the individual sheets within the booklet. The deskew apparatus of the present invention can be integrated with a booklet making apparatus to enable the aligning, trimming to length, scoring, and folding steps of the process. The process flow 100 in FIG. 1 and the apparatus of FIG. 11 are both referred to in the description that follows. Shown in FIG. 11 are the feed rollers 322, deskew rollers 332 and 334, the print media feedpath 370, a trimming station 610, a plurality of sensors 640, a scoring and folding station 620 and a stacking and stapling station 630. The feed rollers, the deskew rollers and the plurality of sensors are used to feed and align a sheet moving along the feedpath, step 110. Next, the sheet is fed part way through the deskew rollers and held in position while the trimming station trims the sheet to length, step 120. The trimming is discarded of at step 150. The trimmed sheet is fed further through the deskew rollers to the scoring and folding station, where it is scored and folded, steps 130 and 140, again while being held within the deskew rollers. Finally, the folded sheet is fed completely through the deskew rollers and progressed to the stacking and stapling station, where it is stacked with other finished sheets and then stapled to make a booklet, step 160.

A possible modification to the alignment method described with reference to FIG. 6 relates to the technique for inducing the buckle 312 in the sheet 310. Rather than stalling the deskew rollers 332 and 334, the buckle may be induced by reverse driving. For example, the sheet of print media may be fed partially through the deskew rollers, whereafter stalling of the feed rollers 322 and reversal of the deskew rollers will cause the buckling to occur. The reversal of the deskew rollers should continue until the leading edge of the sheet resides within the nip of the deskew rollers. Subsequently, all operations will be identical to those that were previously described.

Other possible modifications of the invention relate to the deskew rollers and the sensors. Non-optical sensing members may be substituted. Similarly, deskew members other than rollers may be used without diverging from the invention.

What is claimed is:

1. A deskew apparatus comprising:

a feedpath along which print medium is supplied;

a deskew mechanism configured to achieve a desired alignment of a leading edge of said print medium relative to said feedpath;

at least two sensing members downstream of said deskew mechanism, including a first sensing member having a fixed position near one side of said print medium progressing along said feedpath and including a second sensing member mounted for movement so as to accommodate print media of different dimensions, said sensing members being enabled to generate data indicative of an actual alignment of said leading edge relative to said feedpath; and a controller enabled to reverse a direction of said print medium in response to determination via said data that said actual alignment is outside of a tolerance of said desired alignment, said controller being configured to continue said reversing to return said leading edge to said deskew mechanism.

2. The deskew apparatus of claim 1 wherein said first and second sensing members are optical sensors and wherein said second sensing member is mounted to a carriage which is movable along a carriage transport rail.

3. The deskew apparatus of claim 1 wherein said deskew mechanism comprises deskew rollers having a nip in which said leading edge is fed to promote said desired alignment.

4. The deskew apparatus of claim 3 further comprising a reversible motor coupled to said deskew rollers, said reversible motor being responsive to said controller so as to determine movements of said print medium along said feedpath.

5. The deskew apparatus of claim 1 wherein said controller is configured to define a limit to a number of times that said print medium is reversed in direction as said response to determination that said actual alignment is outside of said tolerance, said limit being greater than one.

6. The deskew apparatus of claim 1 further comprising a feed mechanism coupled to a supply of sheets of said print medium, said feed mechanism being cooperative with said deskew mechanism to induce buckling of each said sheet upon contact of said sheet with a nip region of said deskew mechanism.

* * * * *